United States Patent [19]

Dumdum et al.

[11] Patent Number: 4,908,142

[45] Date of Patent: Mar. 13, 1990

[54] EXTREME PRESSURE LUBRICATING COMPOSITIONS AND METHOD OF USING SAME

[75] Inventors: Josefina M. Dumdum, Chino Hills; Leah T. Mendelson, Santa Ana; Richard L. Pilling, Fullerton, all of Calif.

[73] Assignee: Union Oil Company of California, Brea, Calif.

[21] Appl. No.: 260,912

[22] Filed: Oct. 21, 1988

[51] Int. Cl.[4] ..... C10M 135/14

[52] U.S. Cl. ..... 252/17; 252/28; 252/29; 252/32.5; 252/34; 252/35; 252/38; 252/41; 252/42.7; 72/42

[58] Field of Search ..... 252/42.7, 35, 17

[56] References Cited

U.S. PATENT DOCUMENTS 4,476,113 10/1984 Young et al. ..... 424/161
4,551,167 11/1985 Young et al. ..... 71/903
4,726,144 2/1988 Young et al. ..... 405/36

OTHER PUBLICATIONS

Mills et al., Journal of the Chemical Society, vol. 1928 (II), pp. 2326–2332, (1928).
O'Donoghue et al., Journal of the Chemical Society, vol. 89 (II), pp. 1812–1818, (1906).
Yeoman, Journal of the Chemical Society, vol. 119, pp. 38–54, (1921).

*Primary Examiner*—William R. Dixon, Jr.
*Assistant Examiner*—Ellen M. McAvoy
*Attorney, Agent, or Firm*—Gregory F. Wirzbicki; Arthur E. Oaks; Michael H. Laird

[57] ABSTRACT

Additives containing a salt or complex of trithiocarbonic acid are useful in lubricants to enhance the extreme pressure/anti-wear and anti-oxidation capabilities thereof. The lubricants are preferably oils of lubricating viscosity, which may be thickened to a grease-like consistency with one or more oil thickeners, and contains from about 0.1 to about 20 weight percent of said additives.

84 Claims, No Drawings

EXTREME PRESSURE LUBRICATING COMPOSITIONS AND METHOD OF USING SAME

BACKGROUND OF THE INVENTION

1. Field of the Invention

This invention relates to lubricating compositions and more particularly to improved lubricating compositions and most particularly to a lubricating composition having improved anti-wear/extreme pressure and antioxidant properties.

2. Description of the Prior Art

Over the years, the development of satisfactory lubricating oil and grease compositions for use under extreme pressure, high temperature and high speed conditions has received widespread attention. Consequently, numerous additives have been proposed to enhance the physical and chemical properties of these compositions when intended for such service. Such additives are compounds that generally contain lead, sulfur, phosphorus, halogen (principally chlorine), and carboxylate salts, organic phosphates and phosphites. The list also includes chlorinated waxes, sulfurized unsaturated organic compounds, heavy metal sulfides such as lead sulfide and molybdenum disulfide, and antimony thioantimonate.

These additives, although effective under extreme pressure conditions and high temperature conditions, have certain disadvantages. For example, environmental concerns make lead-containing additives undesirable. Antimony thioantimonate, another widely accepted additive for producing extreme pressure lubricants and greases, is expensive, thus significantly increasing the manufacturing costs of said lubricants. Because of its toxicity, disposal is also costly. There is therefore a need for an extreme pressure additive which is environmentally benign and inexpensive to use. The present invention provides such an additive.

SUMMARY OF THE INVENTION

The present invention is an extreme pressure lubricating composition comprising a major amount of a lubricant and a minor amount of a metal salt or complex of trithiocarbonic acid, said salt or complex being used to provide improved resistance to oxidation and/or anti-wear/extreme pressure (EP) protection for bearings, gears and other mechanical structures subjected to heavy sliding or rolling loads.

DETAILED DESCRIPTION OF THE INVENTION

The lubricating compositions of the present invention contain an oil of lubricating viscosity, a salt or complex of trithiocarbonic acid, and, when a grease, one or more thickeners.

The lubricating oils which form the major component of the lubricating compositions disclosed herein are oils which have a viscosity within the range of about 35 to about 200 SUS at 210° F., said oils being derived from "mineral oils" such as petroleum, shale, gasified coal, bitumen, tar sands, etc., and synthetic oils. Suitable petroleum base oils are derived from distillate lubrication oils which have an initial boiling point of about 350° F. to about 475° F., an endpoint in the range of about 500° F. to about 1100° F., and a flash point not lower than about 110° F.

Synthetic lubricating oils useful herein are those oils derived from a product of chemical synthesis, i.e., manufactured oils. Typical examples of such compositions include polyglycol fluids such as polyalkylene glycols, silicones, which are a silicon-oxygen polymeric chain to which are attached hydrocarbon branches composed of either alkyl or phenyl groups, phosphates, polyphenyl esters, synthetic hydrocarbons and various esters of organic acids with alcohols.

When an additive is used to provide EP or other desirable properties to a lubricating oil, the lubricating oil preferably comprises at least 50 weight percent, more preferably at least 60 weight percent, and most preferably at least 70 weight percent of the lubricating composition. To form a grease, the lubricating oil is conveniently thickened to a grease consistency with an oil thickener. Generally two types of thickeners are used to form grease compositions, soaps and/or non-soaps.

A soap-base thickening agent as used herein is defined as being one or more metal soaps of saponifiable fats, oils or fatty acids capable of providing a stable gel structure to lubricating base oils. Typical fatty acids used herein are those which have carbon chains from about 10 to about 40 atoms ($C_{10}$ to $C_{40}$), preferably from about 15 to about 30 atoms in length. Other saponifiable materials used in the manufacture of lubricating greases include distilled rosin oil, naphthenic acids, sulfonic acids, montan wax and wool wax.

The term soap-base is intended to include simple metal soaps, mixed base soaps and complex soaps, as follows:

Simple metal soaps:

Soaps of aluminum, barium, calcium, lithium, sodium, lead, strontium and magnesium such as stearates, oleates hydroxystearates, acetates, sulfonates, azelates, acrylates, palmitates and benzoates.

Mixed base soaps:

Soaps of two or more metals in mixtures of varying amounts such as stearates, oleates, hydroxystearates, acetates, sulfonates, azelates, acrylates, palmitates and benzoates of aluminum-calcium, aluminum-lead, aluminum-lithium, aluminum-sodium, aluminum-zinc, barium-aluminum, barium-calcium, barium-lithium, calcium-magnesium, calcium-sodium, lithium-aluminum, lithium-aluminum-lead, lithium-aluminum-zinc, lithium-calcium, lithium-potassium, lithium-sodium, sodium-barium, sodium-calcium, sodium-lead, sodium-lithium and sodium-zinc.

Complex soaps:

Soaps having dissimilar acid radicals associated with a single metal ion or those soaps mixed with low molecular weight salts or polar compounds, or such metal soaps formed from dicarboxylic acids. Examples include aluminum benzoate-stearate-hydroxide (aluminum complex), barium acetate-stearate (barium complex), calcium acetate-stearate (calcium complex) and dilithium azelate mixed with lithium borate (lithium complex).

Non-soap thickeners include all those thickeners that are not prepared by the process of saponification. Such materials include one or more organo-clays such as bentonite, kaolinite, montmorillonite, monazite and hectorite, polymers, polyurea, silica gel, carbon black, dyes and pigments.

In use, the oil thickener is generally mixed with the lubricating oil in an amount sufficient to impart a grease-like consistency to the oil, generally at a concentration between about 0.1 and about 30 weight percent of the combined lubricating composition and preferably between about 2 and about 20 weight percent.

The extreme pressure additives which impart enhanced load-carrying characteristics to the lubricating compositions of the present invention comprise one or more salts or complexes of trithiocarbonic acid ($H_2CS_3$). The trithiocarbonate salts used as extreme pressure additives in the present invention may be prepared in solid form by reacting a mixture, preferably a stoichiometric mixture, of a source of sulfide, preferably hydrogen sulfide, and carbon disulfide with a substituted metal oxide of the form $M(OR)_y$, wherein M is ammonium, quaternary ammonium, quaternary phosphonium or a metal, y, the valence of M, ranges from 1 to 4, preferably 1 or 2, and R is hydrogen or, preferably, an organic aliphatic radical having up to about 10 carbon atoms, and preferably a saturated aliphatic radical, and most preferably an alkyl radical of up to about 5 carbon atoms, said reaction being performed under conditions sufficient to produce the trithiocarbonate salt according to the general reaction:

$$2M(OR)_y + yH_2S + y\ CS_2 => M_2(CS_3)_y + 2y\ HOR \quad (1)$$

It is also known that the trithiocarbonate ion can act as a ligand to form complexes of the form:

$$(CI)_x(M_z(CS_3)_y)$$

wherein M is a cationic metallic element, preferably a transition metal such as iron, cobalt, nickel, platinum, copper, zinc, chromium, manganese, molybdenum, etc., y is the number of trithiocarbonate groups in the complex, z is the number of atoms of M in the complex, CI is a neutralizing counter ion, preferably quaternary ammonium or quaternary phosphonium, and x is the number of counter ions necessary to neutralize the complex. These complexes have a variety of ligand-to-metal ratios depending upon the nature and valence of the transition metal used.

One method for the preparation of such complexes is by reacting a mixture of an alkali metal trithiocarbonate, prepared as described above, with a soluble complex forming metallic moiety and a soluble cationic counter ion, preferably one containing quaternary ionic groups of the form:

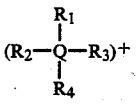

with Q being nitrogen or phosphorus and each R group being separately and independently hydrogen or, preferably, an organic radical, said organic radical preferably being an alkyl, aryl, cycloalkyl or alkylaryl group having up to about 50 carbon atoms. It is understood that other cationic counter ionic moieties such as alkali and alkaline earth metals may be substituted for quaternary ammonium or phosphonium, for example, by ion exchange techniques. Still other methods for preparing salts and complexes of trithiocarbonic acid are given in ("Topics in Sulfur Chemistry" Vol. 2, pages 161 to 171, E. Senning, ed., Publ. George Thieme, Stuttgart.

However, for the purposes of the present invention, the salt-forming moiety is preferably a metal, more preferably selected from the alkaline earth and alkali metals, most preferably, it is an alkali metal selected from lithium, sodium, potassium, cesium and rubidium, and very most preferably, it is potassium.

When an alkaline earth or alkali metal is used as the salt-forming cationic. moiety, reaction (1) preferably takes place in an anhydrous alcohol such as absolute ethanol from which the trithiocarbonate salt precipitates as a free flowing yellow-orange powder. An alkoxide precursor such as potassium ethoxide, KOEt, may be generated in-situ by contacting potassium hydroxide with the alcohol, according to the reaction:

$$KOH + EtOH => KOEt + H_2O \quad (2)$$

Since the presence of water is found to cause significant problems in separating the reaction product, the water generated by reaction (2) must be removed prior to performing reaction (1). One approach for so doing is to heat the solution to a temperature high enough to cause an alcohol-water azeotrope to form and boil off. After the water is removed, the remaining reactants can be added, with the result that an easily handled, free-flowing powder is produced.

Reaction (1) may be carried out at a temperature from 0° C. to the boiling point of carbon disulfide, and preferably from about 15° C. to about 35° C. The reaction is preferably carried out under an inert or reducing gas atmosphere to avoid oxidation of any of the sulfur compounds to sulfur oxide moieties such as thiosulfate. At the conclusion of the reaction, the salt may be recovered from the alcohol suspension by filtration and drying. This should be done under an inert atmosphere to prevent oxidation or hydrolysis of the precipitated salt. When dry, the salt may be safely stored for extremely long periods prior to use. However, it must be kept away from oxygen and moisture since metal trithiocarbonates are hygroscopic and may either hydrolyze to form carbon disulfide or oxidize to form thiosulfates at ambient temperatures and humidities. This may be prevented either by coating the particles with the oil which will be used to form the final lubricating composition or by storing them in sealed containers, preferably under an inert atmosphere.

The trithiocarbonate salt or complex used comprises a minor part (i.e., less than 50 weight percent) of the lubricating composition, typically from about 0.1 to about 20 weight percent, preferably from about 0.5 to about 10 weight percent.

If desired, the additives described herein may be employed in conjunction with other additives commonly employed in lubricants. Thus, there may be added to the basic lubricants of this invention rust inhibitors, tackifiers, corrosion and other oxidation inhibitors and other anti-wear/extreme pressure agents. The only requirement to adding these additional additives herein is that they be compatible with the trithiocarbonate constituent of the lubricating composition.

The trithiocarbonate salts described herein enhance the anti-wear/extreme pressure properties of lubricating oils and greases used to protect mechanical components such as gears, bearings, threaded bolts and couplings, and the like, when subjected to sliding or rolling motion under very heavy loads from experiencing excessive wear. Such enhancement can be shown when lubricants with and without the additives of the present invention are compared using, for example, conventional rotating 4-ball tests either at a constant load, as defined in ASTM D-2296 (for anti-wear evaluation) or under a steadily increasing load, as defined in ASTM D-2596 (for extreme pressure evaluation).

These salts also enhance the stability of lubricants when they are exposed to conditions which result in severe oxidation and degradation of an unprotected lubricant. Such enhancement can be shown by a reduction in the oxygen pressure loss observed when lubricants, with and without the additives of the present invention, are compared under the test conditions of ASTM D-942.

In addition to being a grease component, the trithiocarbonate salts described herein may be dissolved or suspended in a lubricating oil. When a suspension is formed, conventional suspending agents, emulsifiers or suspension stabilizers are employed with the trithiocarbonate salt to ensure that a homogeneous mixture of lubricating oil and trithiocarbonate salt results.

The trithiocarbonate salts described herein may also be incorporated into lubricating pastes. Lubricating pastes, commonly referred to as "pipe dope," are used as thread lubricants, thread sealing and lubricating compounds, or tool joint compounds. Thread lubricants prevent structures comprising threaded metal parts such as pipes, couplings, nuts or bolts from galling, scuffing, and/or seizure during assembly and disassembly and also fill in any irregularities in the threads so that the joint will better withstand high pressures. These lubricants generally contain an EP agent to prevent such damage.

The invention will be further described with reference to the following examples which are provided to illustrate and not limit the present invention.

EXAMPLE 1

Twenty grams (0.36 moles) of reagent grade potassium hydroxide was added to 200 grams of absolute ethyl alcohol, with the mixture being refluxed and vigorously stirred until all of the KOH had dissolved (about 1 hour), after which the water formed was removed by a conventional water-alcohol azeotropic distillation. To the remaining alcoholic solution, after cooling 7.4 grams (0.22 moles) of hydrogen sulfide was added with vigorous stirring, followed by 13.6 grams (0.19 moles) of carbon disulfide which was added through a dropping funnel.

The mixture was then stirred, at room temperature for about 90 minutes while after which a light yellow precipitate of potassium trithiocarbonate was formed. The precipitate was vacuum filtered, under an inert atmosphere, and washed 3 times with ethanol and ether. The washed material was dried, under vacuum, for about 8 hours at 60° C., after which it was ready for use.

EXAMPLE 2

To a grease containing 93 weight percent of SAE 40 oil (70 SUS at 210° F.) and lithium 7 weight percent 12-hydroxy stearate is added potassium trithiocarbonate. The concentration of potassium trithiocarbonate in the final mixture is 3 weight percent. The resulting composition is useful as a lubricating grease.

In accordance with the present invention, the anti-wear/extreme pressure characteristics and/or anti-oxidant characteristics of lubricants are enhanced by adding an effective amount of a metal salt or complex of trithiocarbonic acid. As disclosed in our copending U.S. patent application Ser. No. 253,139, filed Oct. 4, 1988, metal salt and complexes of tetrathiocarbonic acid are also useful for such purposes and one or more of these may be used in combination with the trithiocarbonate salts and complexes of the present invention.

Obviously many modifications and variations of this invention, as hereinabove set forth, may be made without departing from the spirit and scope thereof, and therefore only such limitations should be imposed as are indicated in the following claims. All embodiments which come within the scope and equivalency of the claims are, therefore, intended to be embraced therein.

We claim:

1. A lubricating composition comprising a major amount of a lubricant and a minor amount of a salt or complex of trithiocarbonic acid.

2. The composition of claim 1 comprising a salt of trithiocarbonic acid wherein the salt-forming moiety is selected from the group consisting of ammonium, quaternary ammonium, quaternary phosphonium and metals.

3. The composition of claim 1 comprising a complex of trithiocarbonic acid wherein the complex-forming moiety is selected from the group consisting of cationic complex-forming metallic elements.

4. The composition of claim 1 wherein said lubricant comprises an oil of lubricating viscosity.

5. The composition of claim 1 wherein said lubricant is a grease comprised of an oil and one or more oil thickeners.

6. The composition of claim 5 wherein said oil thickener is selected from the group consisting of simple metal soaps, mixed base soaps, complex soaps, organo clay, polymers, polyurea, silica gel, carbon black, dyes, and mixtures thereof.

7. The composition of claim 2 wherein said salt-forming moiety is ammonium or a metal selected from the group consisting of lithium, sodium, potassium, cesium and rubidium.

8. The composition of claim 2 wherein said moiety is potassium.

9. A lubricating composition comprising a major amount of a lubricant and a minor amount of a metal salt of trithiocarbonic acid of the form $M_2(CS_3)_y$, wherein M is ammonium or a metal and y is the valence of M.

10. The composition of claim 9 wherein said lubricant comprises an oil of lubricating viscosity.

11. The composition of claim 9 wherein said lubricant is a grease comprised of an oil and between about 0.1 and about 30 weight percent of one or more oil thickeners.

12. The composition of claim 11 wherein said thickener is selected from the group consisting of simple metal soaps, mixed base soaps, complex soaps, organo clay, polymers, polyurea, silica gel, carbon black, dyes, and mixtures thereof.

13. The composition of claim 11 wherein M is a metal selected from the group consisting of lithium, sodium, potassium, cesium and rubidium, and said minor amount is between about 0.1 and about 20 weight percent.

14. The composition of claim 9 wherein M is potassium.

15. A lubricating composition comprising a mixture of:

at least 50 percent by weight of a lubricant;

up to about 30 weight percent of one or more oil thickeners; and from about 0.1 to about 20 weight percent of a salt of trithiocarbonic acid.

16. The composition of claim 1 wherein said composition comprises an oil of lubricating viscosity and between about 0.5 and about 10 weight percent of an alkali metal salt of trithiocarbonic acid.

17. The composition of claim 16 wherein said alkali metal is selected from the group consisting of lithium, sodium, potassium, cesium and rubidium.

18. The composition of claim 15 wherein said oil thickener is present in an amount between about 3 and about 20 weight percent.

19. The composition of claim 15 wherein said oil thickener is selected from the group consisting of simple metal soaps, mixed base soaps, complex soaps, organo clay, polymers, polyurea, silica gel, carbon black, dyes, and mixtures thereof.

20. The composition of claim 18 wherein said thickener comprises a lithium soap, a lithium complex soap, or a mixture thereof.

21. A method of enhancing the lubrication of metal components subjected to sliding or rolling motion comprising lubricating said components with the lubricating composition of claim 1.

22. A method of enhancing the lubrication of metal components subjected to sliding or rolling motion comprising lubricating said components with the lubricating composition of claim 9.

23. The method of claim 22 wherein said lubricant comprises an oil of lubricating viscosity.

24. The method of claim 23 wherein said oil further comprises an oil thickener selected from the group consisting of simple metal soaps, mixed base soaps, complex soaps, organo clay, polymers, polyurea, silica gel, carbon black, dyes, and mixtures thereof.

25. The method of claim 22 wherein said lubricating composition further comprises a salt of trithiocarbonic acid of the form $M_2CS_3$ wherein M is a metal selected from the group consisting of lithium, sodium, potassium, cesium, and rubidium.

26. The method of claim 25 wherein M is potassium.

27. The method of claim 25 wherein said minor amount of trithiocarbonate salt is between about 0.1 and about 20 weight percent.

28. A lubricating composition comprising a major amount of a lubricant and a minor amount of the reaction product of a mixture of a metal alkoxide, hydrogen sulfide, and carbon disulfide with said reaction product forming as a result of the reaction of equal moles of carbon disulfide and hydrogen sulfide with 2 moles of the alkoxide moiety.

29. The composition of claim 28 wherein said metal alkoxide is the reaction product of an anhydrous alcohol with a metal selected from the group consisting of alkali and alkaline earth metals or with a metal hydroxide selected from the group consisting of alkali and alkaline earth hydroxides.

30. The composition of claim 28 wherein said alkoxide is potassium ethoxide.

31. The composition of claim 28 wherein said lubricant comprises an oil of lubricating viscosity.

32. The method of claim 28 wherein said lubricant is a grease comprised of an oil and an oil thickener selected from the group consisting of simple metal soaps, mixed base soaps, complex soaps, organo clay, polymers, polyurea, silica gel, carbon black, dyes, and mixtures thereof.

33. The method of claim 28 wherein said minor amount is between about 0.1 and 20 weight percent.

34. The lubricating composition of claim 28 wherein said reaction mixture comprises about equal molar amounts of carbon disulfide and sulfide from said source of sulfide for every two moles of said alkoxide.

35. A lubricating composition comprised of a major amount of a lubricant and a minor amount of a trithiocarbonate complex of the form $$(CI)_x(M_z(CS_3)_y)$$

wherein M is a cationic complex-forming metal, z is the number of atoms of M in the complex, y is the number of trithiocarbonate groups in the complex, CI is a neutralizing counter ion, and x is the number of counter ions necessary to neutralize the complex.

36. The composition of claim 35 wherein M is selected from the group consisting of lead, tin and the transition metals.

37. The composition of claim 35 wherein said transition metal is selected from the group consisting of iron, cobalt, nickel, platinum, copper, zinc, chromium, manganese and molybdenum.

38. The composition of claim 35 wherein said metal is selected from the group consisting of iron, copper, zinc and molybdenum.

39. The composition of claim 35 wherein said counter ion comprises ionic groups of the form:

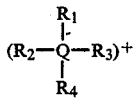

wherein Q is nitrogen or phosphorus and each R group is independently hydrogen or an organic radical.

40. The composition of claim 39 wherein each of said organic radicals is independently selected from the group consisting of alkyl, aryl, cycloalkyl and alkylaryl groups, each of said groups having between 1 and about 50 carbon atoms.

41. The composition of claim 40 wherein each of said R groups is an organic radical.

42. The composition of claim 41 wherein each of said R groups is independently selected from phenyl and alkylaryl groups.

43. The composition of claim 35 wherein said lubricant comprises an oil of lubricating viscosity.

44. The composition of claim 35 wherein said lubricant is a grease comprised of an oil and one or more oil thickeners.

45. The composition of claim 44 wherein said oil thickener is selected from the group consisting of simple metal soaps, mixed base soaps, complex soaps, organo clay, polymers, polyurea, silica gel, carbon black, dyes, and mixtures thereof.

46. The composition of claim 35 wherein said minor amount is between about 0.1 and about 20 weight percent.

47. A method of enhancing the lubrication of metal components subjected to sliding or rolling motion comprising lubricating said components with the lubricating composition of claim 35.

48. The method of claim 47 wherein said lubricant comprises an oil of lubricating viscosity.

49. The method of claim 47 wherein said lubricant is a grease comprised of an oil and one or more oil thickeners.

50. The method of claim 49 wherein said oil thickener is selected from the group consisting of simple metal soaps, mixed base soaps, complex soaps, organo clay, polymers, polyurea, silica gel, carbon black, dyes, and mixtures thereof.

51. The method of claim 47 wherein said composition comprises a metal-trithiocarbonate complex in a concentration between about 0.1 and about 20 weight percent.

52. A lubricating composition comprising a major amount of a lubricant and a minor amount of a complex of trithiocarbonic acid, said complex being the reaction product of a mixture comprising an alkali metal salt of trithiocarbonic acid, a cationic complex-forming metallic moiety, and a counter ion.

53. The composition of claim 52 wherein said alkali metal is selected from the group consisting of lithium, sodium, potassium, cesium and rubidium.

54. The composition of claim 52 wherein cationic complex-forming moiety is selected from the group consisting of lead, tin and the transition metals.

55. The composition of claim 54 wherein said transition metal is selected from the group consisting of iron, cobalt, nickel, platinum, copper, zinc, chromium, manganese and molybdenum.

56. The composition of claim 52 wherein said metal is selected from the group consisting of iron, copper, zinc and molybdenum.

57. The composition of claim 52 wherein said counter ion comprises ionic groups of the form:

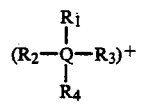

wherein Q is nitrogen or phosphorus and each R group is independently hydrogen or an organic radical.

58. The composition of claim 57 wherein each of said organic radical is independently selected from the group consisting of alkyl, aryl, cycloalkyl and alkylaryl groups, each of said groups having between 1 and about 50 carbon atoms.

59. The composition of claim 58 wherein each of said R groups is an organic radical.

60. The composition of claim 59 wherein each of said R groups is independently selected from phenyl and alkylaryl groups.

61. The composition of claim 52 wherein said lubricant comprises an oil of lubricating viscosity.

62. The composition of claim 52 wherein said lubricant is a grease comprised of an oil and one or more oil thickeners.

63. The composition of claim 62 wherein said oil thickener is selected from the group consisting of simple metal soaps, mixed base soaps, complex soaps, organo clay, polymers, polyurea, silica gel, carbon black, dyes, and mixtures thereof.

64. The composition of claim 52 wherein said minor amount is between about 0.1 and about 20 weight percent.

65. A lubricating composition comprising a major amount of a lubricant and a minor amount of one or more salts or complexes of trithiocarbonic acid in combination with one or more salts or complexes of tetrathiocarbonic acid.

66. The composition of claim 65 comprising one or more salts of trithiocarbonic acid in combination with one or more salts of tetrathiocarbonic acid wherein the salt-forming moiety of said salts is selected from the group consisting of ammonium, quaternary ammonium, quaternary phosphonium, and metals.

67. The composition of claim 65 comprising one or more complexes of trithiocarbonic acid in combination with one or more complexes of tetrathiocarbonic acid wherein the complex-forming moiety is selected from the group consisting of cationic complex-forming metallic elements.

68. The composition of claim 65 wherein said lubricant comprises an oil of lubricating viscosity.

69. The composition of claim 65 wherein said lubricant is a grease comprised of an oil and one or more oil thickeners.

70. The composition of claim 66 wherein said salt-forming moiety is ammonium or a metal selected from the group consisting of lithium, sodium, potassium, cesium and rubidium.

71. A method of enhancing the lubrication of metal components subjected to sliding or rolling motion comprising lubricating said, components with the lubricating composition of claim 65.

72. A lubricating composition comprising a major amount of a lubricant and a minor amount of one or more metal salts of trithiocarbonic acid of the form $M_2(CS_3)_y$, in combination with one or more salts of tetrathiocarbonic acid of the form $M_2(CS_4)_y$, wherein M is ammonium or a metal and y is the valence of M.

73. The composition of claim 72 wherein said lubricant comprises an oil of lubricating viscosity.

74. The composition of claim 72 wherein said lubricant is a grease comprised of an oil and between about 0.1 and about 30 weight percent of one or more oil thickeners.

75. The composition of claim 11 wherein M is a metal selected from the group consisting of lithium, sodium, potassium, cesium and rubidium, and said minor amount is between about 0.1 and about 20 weight percent.

76. A lubricating composition comprising a major amount of a lubricant and minor amount of the reaction product of a mixture of a metal alkoxide hydrogen sulfide and carbon disulfide with said reaction product forming as a result of the reaction of equal moles of carbon disulfide and hydrogen sulfide with 2 moles of the alkoxide moiety in combination with one or more metal salts or complexes of tetrathiocarbonic acid.

77. The composition of claim 76 wherein said metal alkoxide is the reaction product of an anhydrous alcohol with a metal selected from the group consisting of alkali and alkaline earth metals or with a metal hydroxide selected from the group consisting of alkali and alkaline earth hydroxides.

78. The composition of claim 76 wherein said lubricant comprises an oil of lubricating viscosity.

79. The method of claim 76 wherein said lubricant is a grease comprised of an oil and an oil thickener selected from the group consisting of simple metal soaps, mixed base soaps, complex soaps, organo clay, polymers, polyurea, silica gel, carbon black, dyes, and mixtures thereof.

80. A lubricating composition comprised of a major amount of a lubricant and a minor amount of a trithiocarbonate complex of the form $$(CI)_x(M_z(CS_3)_y$$

wherein M is a cationic complex-forming metal, z is the number of atoms of M in the complex, y is the number of trithiocarbonate groups in the complex, CI is a neutralizing counter ion, and x is the number of counter ions necessary to neutralize the complex in combination with one or more complexes of the form $$(CI_x(M_z(CS_4)_y))$$

wherein M, z, y, CI, and x are as defined above.

81. The composition of claim 80 wherein said counter ion comprises ionic groups of the form:

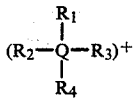

wherein Q is nitrogen or phosphorus and each R group is independently hydrogen or an organic radical.

82. The composition of claim 81 wherein each of said organic radical is independently selected from the group consisting of alkyl, aryl, cycloalkyl and alkylaryl groups, each of said groups having between 1 and about 50 carbon atoms.

83. The composition of claim 81 wherein each of said R groups is an organic radical.

84. A method of enhancing the lubrication of metal components subjected to sliding or rolling motion comprising lubricating said components with the lubricating composition of claim 80.

* * * * *